US006296159B1

(12) United States Patent
De Giovanni

(10) Patent No.: US 6,296,159 B1
(45) Date of Patent: Oct. 2, 2001

(54) DEVICE FOR TURNING TUBULAR TEXTILE PRODUCTS INSIDE OUT

(76) Inventor: Giuseppe De Giovanni, Bettlachstrasse 23, 2540 Grenchen (CH)

( * ) Notice: Subject to any disclaimer, the term of this patent is extended or adjusted under 35 U.S.C. 154(b) by 0 days.

(21) Appl. No.: 09/647,696

(22) PCT Filed: Apr. 20, 1999

(86) PCT No.: PCT/IT99/00098

§ 371 Date: Oct. 3, 2000

§ 102(e) Date: Oct. 3, 2000

(87) PCT Pub. No.: WO99/55947

PCT Pub. Date: Nov. 4, 1999

(30) Foreign Application Priority Data

Apr. 24, 1998 (IT) ..... MI98A0878

(51) Int. Cl.[7] ..... A41M 43/00
(52) U.S. Cl. ..... 223/39; 223/40; 223/43
(58) Field of Search ..... 223/39, 40, 42, 223/43

(56) References Cited

U.S. PATENT DOCUMENTS 5,392,970 * 2/1995 Orosei ..... 223/39

FOREIGN PATENT DOCUMENTS

| | | |
|---|---|---|
| 29 31 566 | 2/1981 | (DE) . |
| 0 430 900 | 6/1991 | (EP) . |
| 0 679 746 | 11/1995 | (EP) . |
| 91 07540 | 5/1991 | (WO) . |

* cited by examiner

*Primary Examiner*—Bibhu Mohanty
(74) *Attorney, Agent, or Firm*—Michael J. Striker

(57) ABSTRACT

A device has been realized for turning tubular textile products inside out, in which a tubular body (22), designed for the purpose, is moved between an idle position and a working position for executing this operation. Active means of suction on the tubular body (22) create a flow of air inside said body when it is in its operative position, and pick-up means (21), placed at the operative position of the tubular body (22), hold the textile product (3) and fit it externally onto the tubular body. Once the product (3) has been fitted onto the tubular body (22), this latter moves from the working position towards the idle position gradually drawing on the textile product and thus completely automating the reversing process.

20 Claims, 4 Drawing Sheets

DEVICE FOR TURNING TUBULAR TEXTILE PRODUCTS INSIDE OUT

Subject of the present invention is a device for turning tubular textile products inside out.

According to this disclosure the device can be used on hosiery production lines to introduce the intermediate stage of turning the open tubular product inside out before proceeding to close one end of the tube.

As is well known, the making of hosiery involves the use of circular machines designed for production of tubular textile products open both at the area of the upper edge and at the toe end.

At this point, in order to complete the manufacturing cycle the toe end of the product must be closed to make it usable by the consumer.

Closing the end consists of making a seam at one end of the hose. To give the finished product a better appearance, this seam is generally made with the hose turned inside out so that any anomalies connected thereto will be inside and therefore unseen.

As the circular machines knit the tubular product with a plain stitch, it must be turned inside out once before going to the finishing stage. Then, once the toe end has been closed the hose must of course be turned inside out again before packing.

These turning operations were usually done manually by workers on the production line, once before sending the hose to the finishing machine and again afterwards.

At present the finishing machine comprises special equipment that automatically and efficiently turns the hose a second time and no particular difficulties arise.

To improve efficiency and working times in turning the hose inside out the first time, one known technique involves the use of semi-automatic machines in which an operator fits the textile product to be turned onto a tube, holding it at the edge, and sliding it along till the toe end reaches the tube's initial opening.

At this point a suction mechanism comes into action with a stream of air that forces the toe of the hose inside the tube, turning it inside out, while the operator slides the hose onto the tube. When the completely turned hose enters the tube the whole of it is drawn inside and taken pneumatically to a collecting station.

In order to eliminate this type of manual operation as well, since it usually slows down production and increases costs, the makers of circular machines have designed special automated systems to go with the circular machines in use.

For example, the circular machines with double roller have been fitted with a suction roller at the top so that by starting suction the hosiery is produced already turned inside out.

In the case of the circular machines with a single roller, these have been fitted with a device that turns the hose inside out during its formation.

Although this solves the problem of a completely automated process, some serious problems remain even so.

The best results are in fact realizable only with double roller machines of the most recent production.

As far as concerns previous models of machines, still widely used, it is often difficult to adopt these devices and even, in some cases, inadvisable and uneconomic.

With regard to the single-roller circular machines, on the other hand, the built-in device for turning hose inside out has been found un-economic when used on both new and old types of machines.

It must be noted in fact that addition of a turning device requires perfect synchronization and very high coupling tolerances between the two devices to get the best performance.

It is no easy matter to realize these changes and it is also clear that an error in synchronization of the parts during operation would cause the hose being produced to ruffle up and be spoilt, as well as loss of time while adjusting the machine; even worse, however, would be the damage done to various component parts of the device and especially to the needles.

It is also important to note that each circular machine must be fitted with its own personal system for turning the product inside out which means that for each machine such a turning device must be designed and assembled.

Purpose of this present invention is therefore to remove the above drawbacks to a substantial degree.

An initial aim is to realize a device that functions separately from the circular machines so as to avoid any problem of synchronization or interference with them during the production process.

A further aim is to realize a device that can execute the first turning operation on the tubular product by a previously fixed number of circular machines, generally more than one and differing one from another.

A further aim still is to realize a device able to execute the first turning operation on textile products of different sizes and types.

These and other aims, to be explained during this description, are substantially achieved by a device for turning tubular textile products inside out as will be described in the claims that follow.

Further characteristics and advantages will become clear from the detailed description of a preferred, but not exclusive, form of execution of a device for turning tubular textile products inside out according to this present invention.

The description will now be given making reference to the attached drawings, supplied for purposes of indication only and therefore placing no limits, in which.

Referring to the above figures, a device 1 is shown for turning a tubular textile product inside out according to the present invention.

Figure 1:
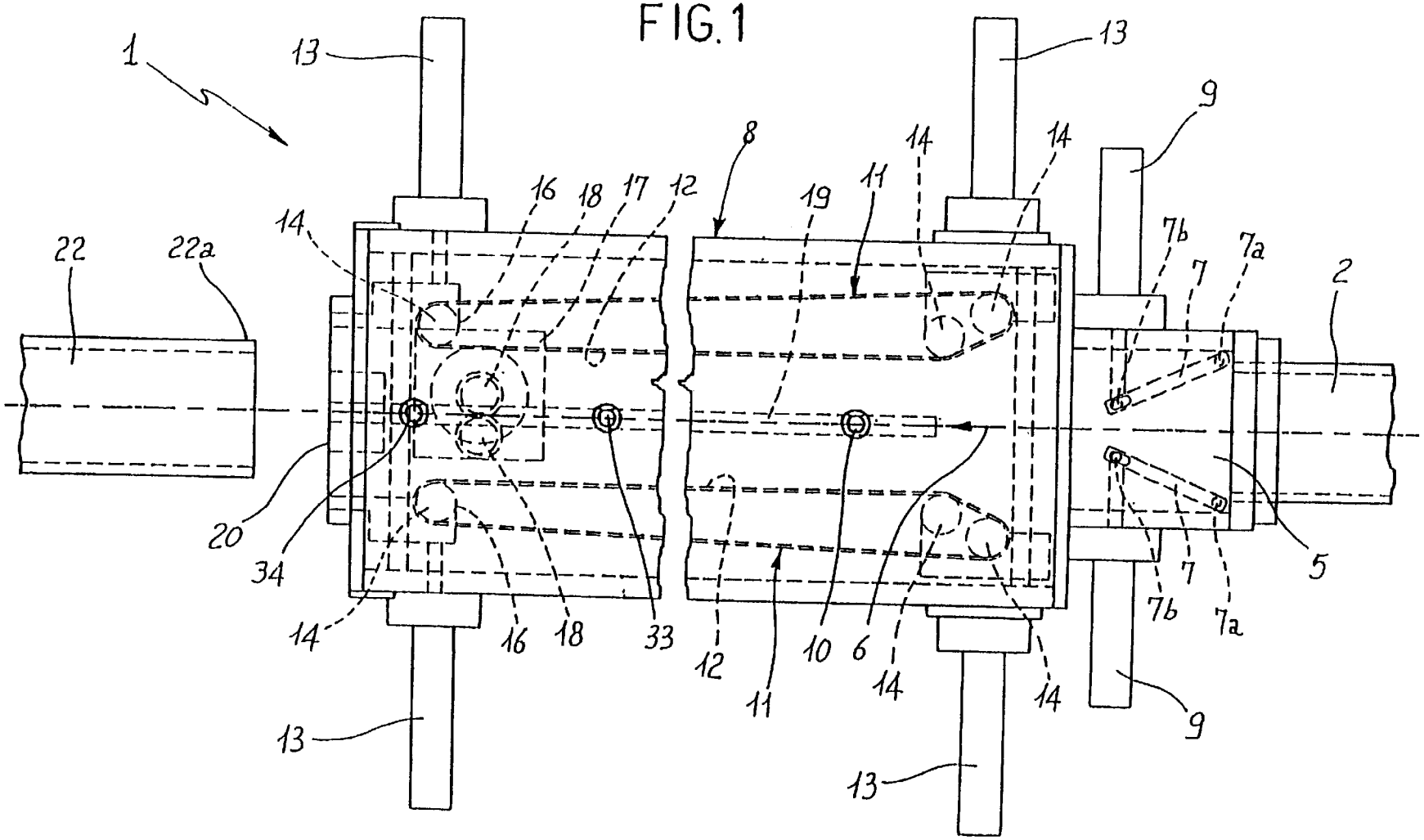
FIG. 1 shows a device for turning tubular textile products inside out according to the present disclosure.

The device contains a suction channel 2 (diagrammatically drawn in FIG. 1) that picks up the tubular product 3, generally consisting of a stocking the toe of which is to be seamed, from a feed station) where such items are brought, either manually or automatically, after being manufactured on the circular machines.

Pneumatic devices (not shown) set up a stream of air inside the suction channel 2 to convey the products 3 one after another to an input station 5.

Immediately downstream of the input station 5, in the direction of product feed (shown by the arrow 6), are pressing means 7, for example at least two tabs associated to the supporting frame 8 of the device for turning the product inside out. Said tabs 7 will fold the textile product 3 compressing it longitudinally during its passage.

The tabs 7 consist in practice in lamine the section of each showing one end, 7*a*, hinged to the frame 8 and the other end, 7*b*, free. Moving means 9, preferably consisting of a pair of pneumatically driven pistons, mounted on the device 1, press centrally on said tabs 7 to control their movement.

In particular these tabs can be made to rotate round their first ends 7*a* so that, from a position in which they are parallel one to another, they move to various working positions in which the second ends 7*b* lie closer together so that the tabs 7 converge in relation to the direction of feed 6 of the product 3.

Advantageously the ends 7*b* can assume positions and operate at varying distances one from another (different working conditions), thus enabling them to compress products of different kinds of cloth and/or dimensions and/or shape.

In this configuration, the purpose of the tabs 7 is to force the tubular product 3, hosiery in particular, to reduce its radial bulk and present a flattened transversal section.

Still due to the action of suction, the product 3 continues to move along a direction of feed 6 until its presence is detected by a first sensor 10, generally consisting of a photoelectric cell, that instantly stops the flow of air in the suction channel 2.

The device 1 for turning the product inside out comprises at least two conveyor conveyor belts 11 mounted on the supporting frame 8 by guides that permit them to move, in relation to the frame, at least orthogonally to the direction of feed 6 of the piece of hosiery.

Both conveyor belts 11 present an active surface 12 lying substantially parallel to the direction of feed 6 of the product 3, generally equal one to another and placed symmetrically in relation to said direction of feed 6.

Each of the two conveyor belts 11 is moved by motor-driven means 13 consisting, for example, of a pair of pneumatic pistons placed close to the ends of the conveyor belt 11 that is to say at the position of the rollers 14 which guide the conveyor belt 11

The pneumatic actuators simultaneously move the ends of the conveyor belts 11 so that their active surfaces 12 are brought closer together in a parallel and symmetrical manner in relation to the direction of feed 6 of the product 3.

To activate the conveyor belts 11 a chain transmission system is provided for moving the rollers 14 after being suitably engaged by gear wheels 16.

In greater detail, the rollers for the two conveyor belts 11 placed close to a motor unit 17 mounted on the frame 8, are provided with identical gear wheels 16 fixed firmly and coaxially to said rollers.

These latter gear wheels 16 can be moved together with the conveyor belts 11 and occupy their working position, namely when they mesh with corresponding gear wheels and are moved by the motor unit 17, only when the respective active surfaces 12 have been brought closer together.

The motor unit 17, able to operate the gear wheels 16, 18, is of the variable speed type to permit regulation of its speed and therefore that of the conveyor belts. Though this speed can be varied, it is in any case always the same for both conveyor belts.

The device according to the invention is also provided with lateral guides 19 that extend parallel to the direction of feed 6 of the item of hosiery, and are defined in the area where the convey conveyor belts 11 operate.

These lateral guides 19 in actual fact consist of longitudinal cavities, made in lateral bars for example, and are placed there to receive the folded ends 3*a* of the products 3 to guide them along to the device for turning them inside out.

At one end of the device, opposite to that of the input station 5, is a station 20 comprising pick-up means 21 for engaging the product 3.

Figure 4:
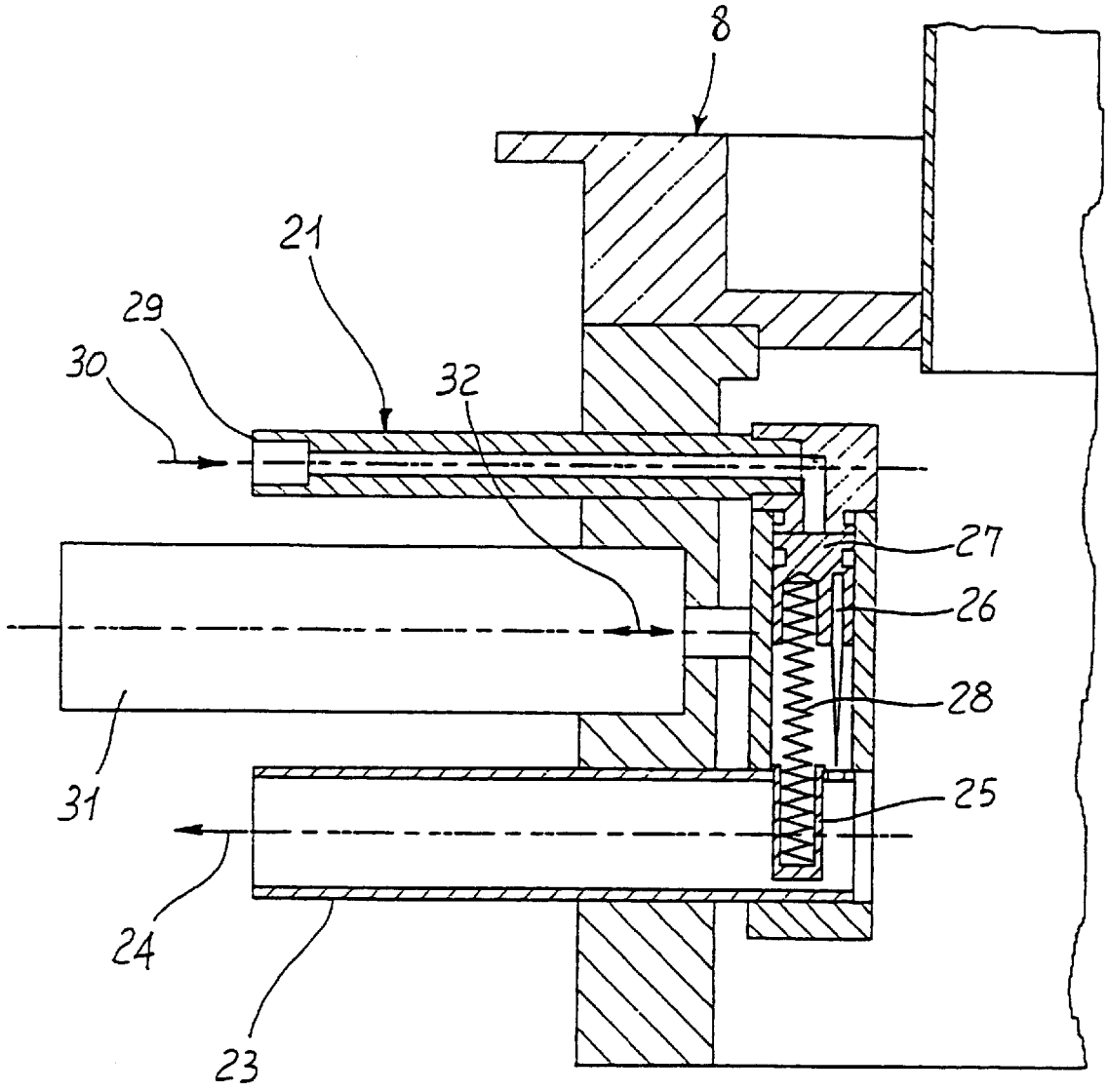
FIG. 4 shows, in cross section, holding means associated to the device in FIG. 1.

These pick-up means 21 (see FIG. 4) are placed there to engage the product 3 and fit it onto the outside of a tubular turning body 22.

The device for turning the product inside out is in fact provided with a tubular turning body 22 mobile between an idle position and at least one working position where it turns the product 3 as stated above.

It should be noted that when the pick-up means 21 are fitting the product onto the tubular turning body 22, this latter is placed so as to offer one end 22*a* (its lower end in the united figures) substantially aligned with said pick-up means 21.

Once the product is fitted on, the tubular turning body 22 moves to its working position by making a parallel movement contrary to the product's direction of feed 6.

The tubular turning body is then in its working position with one end 22*a* inside the supporting frame 8 between the two conveyor belts 11.

To turn the product inside out, means of suction (not shown) are active on the tubular turning body 22, and can create suction inside it when it has reached its working position.

In practice the suction, created once the product 3 has been fitted onto the tubular turning body 22, causes that part of the product lying externally, to be sucked inside said tubular turning body, which has meanwhile been moved towards its idle position, so that the remaining part of the product gradually enters the tube becoming turned inside out while so doing.

Having completed this operation the pick-up means 21 releases the product which then passes through certain tubes, provided for that purpose, to an unloading station.

The pick-up means 21 that holds the product at its upper edge, consists of a portion 23 of a tube into which it is drawn by suitable means of auxiliary suction in the direction shown by the arrow 24.

Figure 2:
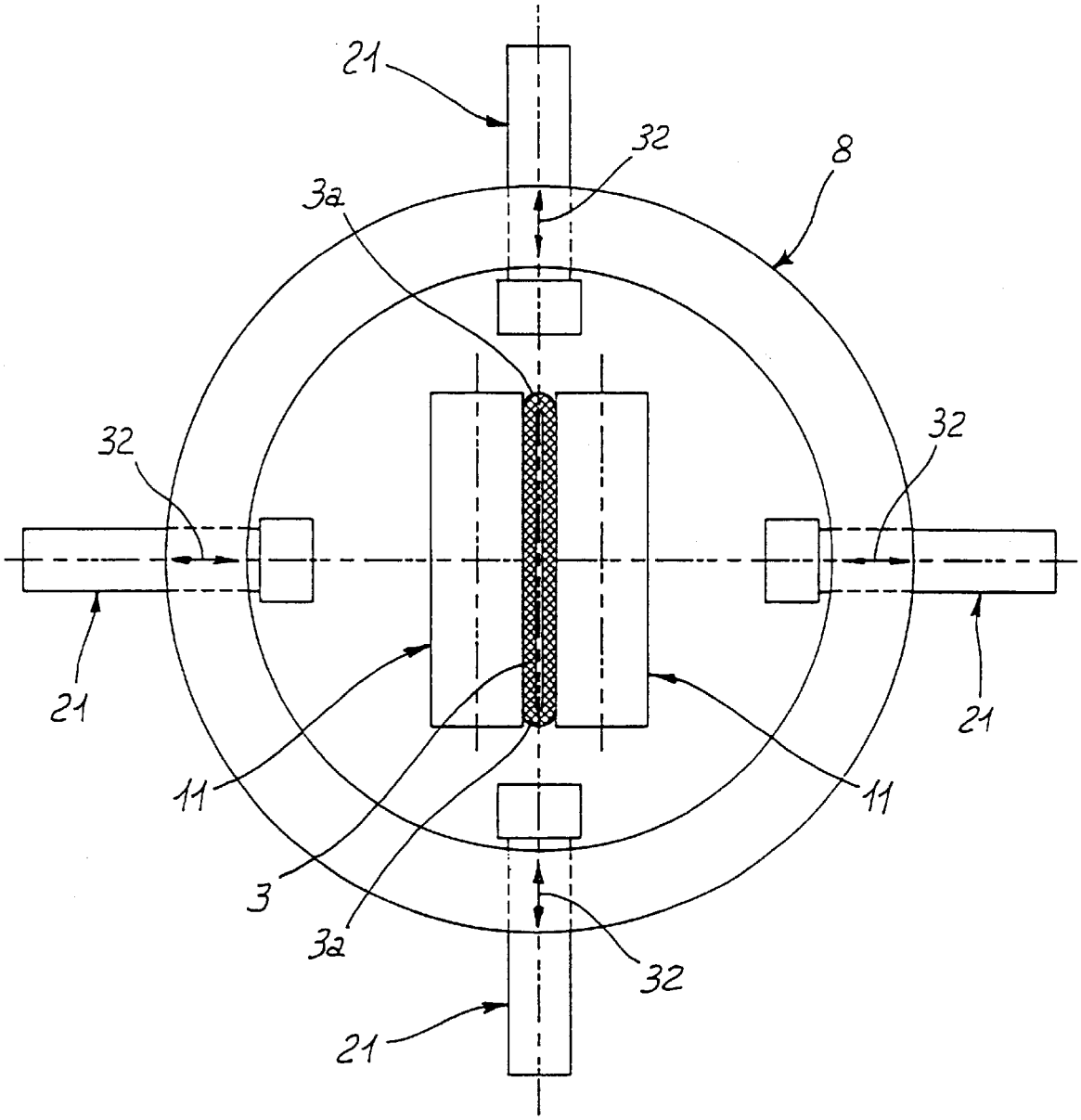
FIGS. 2 and 3 show, in diagrammatical form, the operations of engaging and opening a tubular product on reaching a holding station on the device in FIG. 1.
Figure 3:
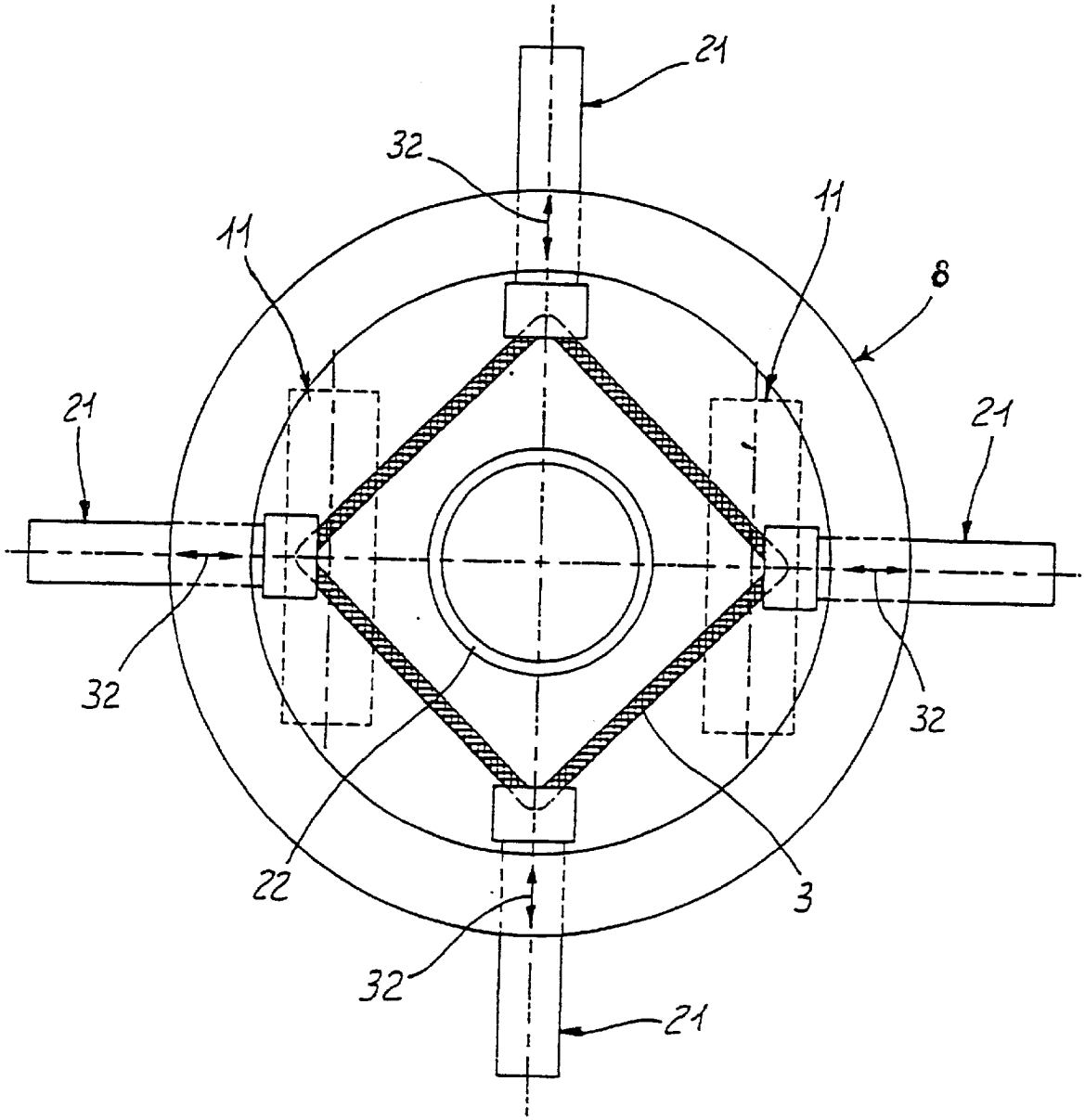

During the engaging operation, said pick-up means 21, of which there are preferably four placed angularly and equidistant to grip the product at four different points on its outer edge (as seen in FIGS. 2 and 3), are brought close to the product and, in the portion of tube 23, a suction force is generated that partially draws one edge of the product inside said portion of tube 23.

Advantageously the pick-up means 21 also comprise at least one holding element 25 inside the portion of tube 23 and preferably lying across the edge of the product (vertical in the figure) to prevent a damaging quantity of material from being drawn in.

There is also at least one part 26 that actively locks the product, said part being moveable from an idle to an operative position where it enables the edge of the product to be held by the pick-up means 21.

The locking part 26 consists of at least one mobile needle, pressed by pneumatic thrusting means from an idle position, where it lies outside the portion of tube 23, to an operative position where it crosses both the portion of tube 23 and the edge of the product 3.

In practice the needle is firmly associated to a mobile block 27 that moves in a guide orthogonal to the axis of the portion of tube 23.

The block 27 and therefore the needle as well are held in an idle position with the needle completely external to the portion of tube 23 held there by an elastic part 28 which in this particular execution consists of a spring.

When one part of the product has been partially drawn inside the portion of tube 23 and held there by the internal holding element 25, a stream of air (in direction 30) passes through a further portion of tube 29, and exerts a force on the block 27 such as can overcome resistance from the elastic part 28.

The block 27 then moves along the guide fixed to the needle that passes through a hole made in the lateral wall of a mouth of the portion of tube 23, penetrating it through the stitches of the product and meeting the opposite wall so that the product is firmly held.

Obviously, when valves are used to take off the pressure in the further portion of tube 29, the elastic element returns the block 27 to its idle position and the needle releases the tubular product.

Looking at FIG. 4 again, the presence can be noted of a piston 31 able to move the pick-up means 21 in a radial direction (radial movement of the pick-up means 21 is seen in FIGS. 2 and 3 marked with number 32).

It may be further noted that subject device also comprises counting means associated to the frame 8 able automatically to count the number of products on which the machine has operated.

A device according to the present disclosure works as follows. Suction is activated through the channel 2 so that a product 3 is taken from the feed station and carried by the stream to the input station 5.

From there, still carried by the stream of air, the product 3 is made to pass through two tabs 7 so arranged as to deform and partially compress it.

On reaching a first photoelectric cell 10, said cell cuts off the flow of air and simultaneously starts up the motor-driven means 13 that permits the conveyor belts 11 to approach the product.

On reaching a position where said conveyor belts can bring their respective active surfaces 12 in contact with the outer surface of the product 3 and when the gear wheels 16, 18 have meshed together, the motor-driven unit 17 is activated to start up movement of the conveyor belts 11.

The item of hosiery, whose edges are guided by the lateral guides 19 with the opposite outer surfaces carried by the conveyor belts 11 is brought forward till its presence is detected by a second sensor, this also being a photoelectric cell, placed on the supporting frame 8.

This second photoelectric cell 33 is placed at a distance previously set by and known to the first cell 10 and can modify the speed of the conveyor belts 11 to bring the textile product to the exact position of the pick-up station 20.

A third sensor 34, a photoelectric cell for example, placed downstream of the second sensor 33, in relation to the direction of feed 6 of the product 3, determines the presence and correct position of the item of hosiery by stopping movement of the conveyor belts 11.

At this point the two pick-up means 21, or pincers, lying outside the surface of the centre-line of the compressed edge, take up a first operative position and move to pick up the edge of the hose.

When the needles of the first two pick-up means have engaged the hose, the other two pick-up means approach its edge and engage their respective tips on the outer surface of the product 3.

The pneumatic pistons 31, associated to each of the pick-up means 21, move them away radially towards a second operative position carrying the tubular product from a closed position, seen in FIG. 2, to an open position as in FIG. 3.

Simultaneously with descent of the tubular turning body 22, the conveyor belts 11 are stopped and their active surfaces 12 separated to permit entry of the tubular turning body 22 and prepare the device for a further working cycle.

At the same time the tubular turning body 22 for reversing the product is moved from its idle position to the operative one in which it is at least partially in position inside the tubular product 3.

By suitable valve action the means of suction begin their action by drawing the free edge of the product inside the tube.

Movement of the tubular turning body 22 is then begun while maintaining suction active from the working position towards the idle position drawing in more and more of the product. When this is almost entirely inside the tubular turning body, the pick-up means 21 release the edge of the product which is then drawn in, fully turned inside out and carried away to a discharging station.

Clearly it is possible to regulate the force of suction, the distance between the free ends of the tabs, as well as the operative distance between the active surfaces of the conveyor belts so as to suit the device to the different types, sizes and shapes of the products to be turned inside out.

The invention offers important advantages.

First of all it should be noted that the described devices can make the operation of turning hose inside out completely automated with great benefit to the entire manufacturing cycle, and this is possible even with hosiery machines of an old design.

The fact that the device is of a universal type is also important as this means it can operate on textile products made using different types of circular machines and is adaptable to hose of different shapes and sizes.

Of great advantage is a reversing device of the type described, able to operate downstream of more than one circular machine so that manufacturing speeds and times can be increased. This increase is due not only to total automation of the process but also to the fact that the device can be connected to a large number of such machines.

Further advantages are derived from its more specific aspects. The presence of the holding element means that the particular pick-up means used do not apply undue stresses to the fibres of the hosiery.

As needles are used for this holding process, the hosiery is not damaged during this operation.

The device can further be effectively adapted to production lines that contain automatic systems of collection of the hosiery produced by the circular machines, the operator taking no part in any of the operations of collection or of turning the product inside out.

What is claimed is:

1. Device for turning tubular textile products inside out comprising:

a suction channel (2) for picking up the textile product (3) from a feed and conveying station by a flow of air to an input station (5)

a supporting frame (8)

a tubular turning body (22) associated to the frame (8) mobile between an idle position and at least one working position at which it turns the textile product (3) inside out means for creating suction inside the tubular turning body (22) when this latter is in the working position pick-up means (21) associated to the frame (8) situated so as to grip the textile product (3) at its edge and place it in position round the tubular turning body (22)

characterized in that it comprises, in line between the suction channel (2) and the tubular turning body (22):

means (7) for pressing the textile product (3) during its passage, placed downstream of the input station (5)

two conveyor belts (11) engaged to the frame (8) having an active surface (12) substantially parallel to the direction of feed (6) of the textile product (3), placed between the pressing means (7) and the tubular turning body (22) whose end (22*a* ), in its working position, lies inside the frame (8) between the two conveyor belts (11)

a first pair of pick-up means (21) placed, on a first longitudinal geometrical plane of symmetry of the pressed textile product (3), at each end of said textile product (3) and a second pair of pick-up means set on a second transversal geometrical plane of symmetry orthogonal to said first geometrical plane respectively on either side of said textile product (3), permitting the pick-up means (21) of each pair, by pulling in the opposite direction on the edges of the textile product, (3) on leaving the conveyor belts (11), to open it in a practically square shape substantially in line with the tubular turning body (22) with sides considerably longer than the external diameter of said tubular turning body (22).

2. Device for turning a product inside out as in claim 1, characterized in that the pick-up means (21) comprise a tubular portion (23) one end of which during operative conditions, is positioned at the area at the edge of the product (3) and means of auxiliary suction selectively active on the tubular portion (23) to generate suction and engage said edge area at the end of the tubular portion (23).

3. Device for turning a product inside out as in claim 2, characterized in that the tubular portion (23) of the pick-up means (21) presents at least one internal holding element (25), preferably place transversally to the edge area, whose purpose is to prevent the effect of suction being such as would damage the textile product (3).

4. Device for turning a product inside out as in claim 2, characterized in that the pick-up means (21) also comprises at least one locking part (26) for the textile product (3) moveable between an idle position, when it is outside the tubular portion (23), and an active position when it holds the edge area of the textile product (3) to the tubular portion (23).

5. Device for turning a product inside out as in claim 1, characterized in that there are four pick-up means (21) spaced angularly equidistant to grip the product at four separate points on its external surface.

6. Device for turning a product inside out as in claim 4, characterized in that the locking part (26) comprises pneumatic thrusting means, and at least one mobile needle, pressed by the pneumatic means from the idle position, in which it lies outside the tubular portion (23), to the operative position in which it crosses both the tubular portion (23) and the edge area of the product (3).

7. Device for turning a product inside out as in claim 4, characterized in that the locking part (26) comprises an elastic element (28), preferably a spring, tending to return said locking part (26) to the idle position.

8. Device for turning a product inside out as in claim 6, characterized in that the pick-up means (21) can move between a first operative position in which they hold one edge area of the product (3) and a second operative position in which they permit insertion through the edge area of the reversing tubular body (22) in the textile product (3).

9. Device for turning a product inside out as in claim 1, characterized in that it comprises a first sensor (10) able to detect passage of the product (3) and stop the flow of air in the suction channel (2).

10. Device for turning a product inside out as in claim 9, characterized in that the pressing means (7) comprises at least two pressing tabs (7) each having a first end (7*a*) hinged to the supporting frame (8) and a second end (7*b*) free, placed in a converging configuration in relation to the line of feed (6) of the product (3).

11. Device for turning a product inside out as in claim 10, characterized in that it also comprises active means (9d) for moving the pressing tabs (7) to a vary a relative distance between the respective second ends (7*b*) of said pressing tabs (7).

12. Device for turning a product inside out as in claim 1, characterized in that said conveyor belts (11) are held to the supporting frame (8) by guides that permit movement between said belts (11) and said frame (8) at least in a direction orthogonal to the line of feed (6) of the product (3) to permit the active surfaces (12) of the conveyor belts (11) to approach each other or separate parallel one to another.

13. Device for turning a product inside out as in claims 1 and 11, characterized in that the first sensor (10) having detected the presence of a product (3), causes the conveyor belts (11) to approach bringing their respective active surfaces (12) into contact with the corresponding outer surface of the tubular product (3).

14. Device for turning a product inside out as in claim 1, characterized in that it also comprises counting means associated to the frame (8) and set to make an automatic count of the reversed products.

15. Device for turning a product inside out as in claim 1, characterized in that it also comprises lateral guides (19) extending parallel to the line of feed (6) and defined at the position of the conveyor belts (11) to guide the product (3) during its movement by means of said conveyor belts (11).

16. Device for turning a product inside out as in claim 11, characterized in that it comprises at least a second sensor (33) placed on the frame (8) downstream of the first sensor (10) in relation to the line of feed (6) of the product (3), and able to vary the speed of movement of the belts (11) so that the product (3) can be stopped in a desired position.

17. Device for turning a product inside out as in claim 16, characterized in that it comprises at least a third sensor (34) placed on the frame (8) downstream of the second sensor (33) in relation to the line of feed (6) of the product (3) and able to verify the presence of said product (33) and stop movement of said conveyor belts (11).

18. Device for turning a product inside out as in claim 15, characterized in that it also comprises motor-driven means (13) operating on each conveyor belt (11) for simultaneous approach or separation of the active surfaces (12) of said belts in at least one direction orthogonal to the line of feed (6) of the product (3).

19. Device for turning a product inside out as in claim 18, characterized in that the motor-driven means (13) comprise at least four pneumatic pistons to act on the respective end portions of each conveyor belt (11) for simultaneous approach or separation of said belts' active surfaces (12) in a direction orthogonal to the line of feed (6) of the product (3).

20. Device for turning a product inside out as in claim 10, characterized in that the second ends (7*b*) of the pressing tabs (7) can take up different positions for a variety of operative conditions in which the ends (7*b*) lie at varying distances one from another to operate on products of different types.

* * * * *